US012753354B2

(12) United States Patent
Hodgkins et al.

(10) Patent No.: US 12,753,354 B2
(45) Date of Patent: Oct. 6, 2026

(54) METHODS FOR PROCESSING AROMATIC COMPOUNDS

(71) Applicant: Saudi Arabian Oil Company, Dhahran (SA)

(72) Inventors: Robert Peter Hodgkins, Dhahran (SA); Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 190 days.

(21) Appl. No.: 18/583,515

(22) Filed: Feb. 21, 2024

(65) Prior Publication Data

US 2025/0263610 A1 Aug. 21, 2025

(51) Int. Cl.
*C10G 69/10* (2006.01)

(52) U.S. Cl.
CPC ..... *C10G 69/10* (2013.01); *C10G 2300/4006* (2013.01); *C10G 2300/4012* (2013.01);
(Continued)

(58) Field of Classification Search
CPC ..... C10G 69/10; C10G 2300/4006; C10G 2300/4012; C10G 2300/4081;
(Continued)

(56) References Cited

U.S. PATENT DOCUMENTS 10,053,401 B1 8/2018 Beadle et al.
10,093,873 B2 10/2018 Koseoglu et al.
(Continued)

FOREIGN PATENT DOCUMENTS

WO 2021155408 A1 8/2021

OTHER PUBLICATIONS

Notification of Transmittal of the International Search Report and the Written Opinion of the International Searching Authority, or the Declaration dated Apr. 16, 2025 pertaining to International application No. PCT/US2025/015715 filed Feb. 13, 2025, pp. 1-12.

*Primary Examiner* — Prem C Singh
*Assistant Examiner* — Juan C Valencia
(74) *Attorney, Agent, or Firm* — Dinsmore & Shohl LLP

(57) ABSTRACT

Aromatic compounds may be processed by a method that may include passing a hydrocarbon feed, hydrogen, and a recycle stream to a reactor and forming a reactor effluent. The recycle stream may include at least 90 wt. % of one or more C11+ aromatic compounds, wherein one or more of C11+ aromatic compounds are alkyl-bridged non-condensed alkyl multi-aromatic compounds. A portion of the alkyl-bridged non-condensed alkyl multi-aromatic compounds may be converted to mono-aromatic compounds in the reactor. The reactor effluent may be passed to a separation unit to form a first separated stream including at least 90 wt. % of one or more C6-C9 aromatic compounds, a second separated stream including at least 90 wt. % of one or more C11+ aromatic compounds, and a third separated stream including at least 90 wt. % of C10 aromatic compounds. The second separated stream may be split into a first portion and a second portion. The recycle stream may consist of the second portion of the second separated stream, and the second portion of the second separated stream may include from 5 wt. % to 95 wt. % of the second separated stream.

20 Claims, 4 Drawing Sheets

(52) U.S. Cl.
CPC . *C10G 2300/4081* (2013.01); *C10G 2300/70* (2013.01); *C10G 2400/04* (2013.01); *C10G 2400/30* (2013.01)

(58) Field of Classification Search
CPC ..... C10G 2300/70; C10G 2400/04; C10G 2400/30; C10G 2300/1096; C10G 47/20; C10G 69/08; C07C 4/26; C07C 4/24
See application file for complete search history.

(56) References Cited

U.S. PATENT DOCUMENTS

| | | | | |
|---|---|---|---|---|
| 10,508,066 | B2 | 12/2019 | Koseoglu et al. | |
| 10,844,295 | B1 | 11/2020 | Koseoglu et al. | |
| 10,899,685 | B1 | 1/2021 | Koseoglu et al. | |
| 10,934,495 | B2 | 3/2021 | Koseoglu et al. | |
| 11,046,899 | B2 | 6/2021 | Hodgkins et al. | |
| 11,149,220 | B2 | 10/2021 | Hodgkins et al. | |
| 11,267,769 | B2 | 3/2022 | Koseoglu et al. | |
| 11,268,037 | B2 | 3/2022 | Koseoglu et al. | |
| 11,279,663 | B2 | 3/2022 | Koseoglu et al. | |
| 11,279,888 | B2 | 3/2022 | Hodgkins et al. | |
| 11,370,980 | B2 | 6/2022 | Koseoglu et al. | |
| 11,459,516 | B2 | 10/2022 | Hodgkins et al. | |
| 2020/0062675 | A1 | 2/2020 | Koseoglu et al. | |
| 2021/0102129 | A1 | 4/2021 | Hodgkins et al. | |
| 2021/0139393 | A1 | 5/2021 | Koseoglu et al. | |
| 2021/0253959 | A1* | 8/2021 | Koseoglu ..... | C10G 65/043 |
| 2021/0253962 | A1 | 8/2021 | Hodgkins et al. | |
| 2021/0269724 | A1 | 9/2021 | Hodgkins et al. | |
| 2021/0277317 | A1 | 9/2021 | Hodgkins et al. | |
| 2022/0033718 | A1 | 2/2022 | Koseoglu et al. | |
| 2022/0033721 | A1 | 2/2022 | Koseoglu et al. | |
| 2022/0220397 | A1 | 7/2022 | Koseoglu et al. | |

* cited by examiner

METHODS FOR PROCESSING AROMATIC COMPOUNDS

TECHNICAL FIELD

Embodiments of the present disclosure generally relate to chemical processing and, more specifically, to methods and systems utilized to process aromatic compounds.

BACKGROUND

Mono-aromatic compounds are valuable precursors in the chemical industry. Examples of mono-aromatic compounds include benzene, toluene, mixed xylenes, ethylbenzene, and propyl benzene. These chemicals can be utilized as building blocks to make various polymers such as polystyrene, phenolic resins, nylon, polyurethane, polyesters. As such, there is a need for new methods to make such materials.

SUMMARY

One source of mono-aromatic compounds is the conversion of an alkyl-bridged non-condensed alkyl multi-aromatic compounds to mono-aromatic compounds in the presence of hydrogen (sometimes referred to as hydrodearylation). These alkyl-bridged non-condensed alkyl multi-aromatic compounds may be present in C9+ aromatic-containing streams that are produced in refining operations. Following the hydrodearylation, the bulk of the mono-aromatics may be separated from multi-aromatic compounds that were not converted, where the bulk of the multi-aromatic compounds may be recycled to the hydrodearylation reaction or may exit the system in a bleed stream. It has been presently discovered that C10 aromatic compounds should be passed out the system as a product, rather than being recycled in the system. In particular, C10 aromatic compounds may include condensed aromatic compounds that, if recycled, would build up in the system and not be converted to mono-aromatic compounds. As such, embodiments of the present disclosure utilize a separation step that separates C6-C9 aromatic compounds and C10 aromatic compounds from C11+ aromatic compounds.

According to one or more embodiments, a method for processing one or more aromatic compounds may include passing a hydrocarbon feed, hydrogen, and a recycle stream to a reactor, such that the hydrocarbon feed, the hydrogen, and the recycle stream are contacted with one another in the reactor and form a reactor effluent. The hydrocarbon feed may comprise at least 99 wt. % of one or more C9+ aromatic compounds, wherein one or more of C9+ aromatic compounds may be alkyl-bridged non-condensed alkyl multi-aromatic compounds. The recycle stream may comprise at least 90 wt. % of one or more C11+ aromatic compounds, wherein one or more of C11+ aromatic compounds may be alkyl-bridged non-condensed alkyl multi-aromatic compounds. A portion of the alkyl-bridged non-condensed alkyl multi-aromatic compounds may be converted to mono-aromatic compounds in the reactor, such that the reactor effluent comprises alkyl-bridged non-condensed alkyl multi-aromatic compounds and mono-aromatic compounds. The method may include passing the reactor effluent to a separation unit to form a first separated stream comprising at least 90 wt. % of one or more C6-C9 aromatic compounds, a second separated stream comprising at least 90 wt. % of one or more C11+ aromatic compounds, and a third separated stream comprising at least 90 wt. % of C10 aromatic compounds. The method may include splitting the second separated stream into a first portion and a second portion, wherein the recycle stream may consist of the second portion of the second separated stream, and the second portion of the second separated stream may comprise from 5 wt. % to 95 wt. % of the second separated stream.

According to one or more additional embodiments, the first portion of the second separated stream may be a bleed stream that is not recycled to the reactor. The method may include combining a portion of the third separated stream with the bleed stream.

According to one or more additional embodiments, the method may include passing a portion of the hydrocarbon feed to a second separation unit to form a light fraction comprising one or more C9-C10 aromatic compounds and a heavy fraction comprising one or more C11+ aromatic compounds. The method may include passing a portion of the heavy fraction to the reactor.

According to one or more additional embodiments, the method may include separating crude oil in a distillation unit to recover at least a naphtha fraction, a diesel fraction, and an atmospheric residue fraction, passing the naphtha fraction to a hydrotreatment unit to produce a hydrotreated effluent, passing the hydrotreated effluent to a catalytic reformer to form a reformate, and passing a portion of the reformate to an aromatics recovery complex to form one or more aromatic-containing streams, wherein the hydrocarbon feed comprises at least a portion of one of the aromatic-containing streams.

These and other embodiments are described in more detail in the Detailed Description. It is to be understood that both the foregoing general description and the following detailed description present embodiments of the subject technology, and are intended to provide an overview or framework for understanding the nature and character of the described technology as it is claimed. The accompanying drawings are included to provide a further understanding of the presently disclosed technology and are incorporated into and constitute a part of this specification. The drawings illustrate various embodiments and, together with the description, serve to explain the principles and operations of the presently described technology. Additionally, the drawings and descriptions are meant to be merely illustrative, and are not intended to limit the scope of the claims in any manner.

BRIEF DESCRIPTION OF THE DRAWINGS

The following detailed description of specific embodiments of the present disclosure can be best understood when read in conjunction with the following drawings, where like structure is indicated with like reference numerals and in which.

Figure 1:
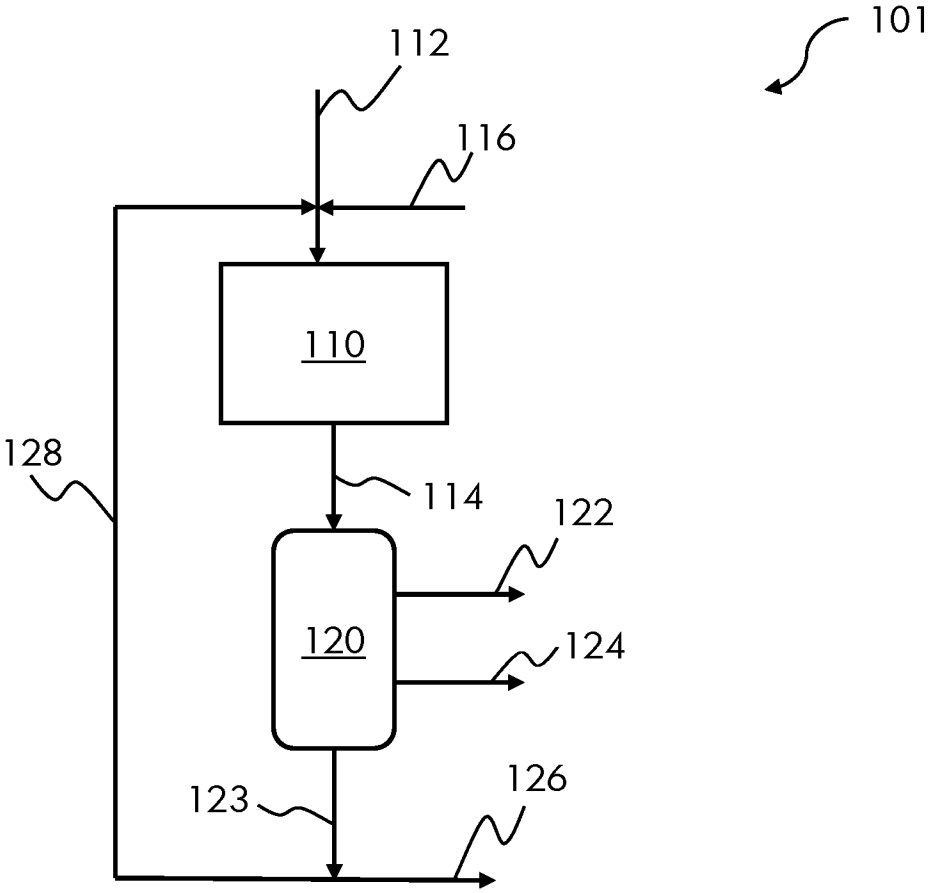
FIG. 1 schematically depicts a diagram of a hydrodearylation system, according to one or more embodiments described in this disclosure.

For the purpose of describing the simplified schematic illustrations and descriptions of the relevant figures, the numerous valves, temperature sensors, electronic controllers and the like that may be employed and well known to those of ordinary skill in the art of certain chemical processing operations are not included. Further, accompanying components that are often included in typical chemical processing operations, such as air supplies, catalyst hoppers, and flue gas handling systems, are not depicted. It should be understood that these components are within the spirit and scope of the present embodiments disclosed. However, operational components, such as those described in the present disclosure, may be added to the embodiments described in this disclosure.

It should further be noted that arrows in the drawings refer to process streams. However, the arrows may equivalently refer to transfer lines which may serve to transfer process streams between two or more system components. Additionally, arrows that connect to system components define inlets or outlets in each given system component. The arrow direction corresponds generally with the major direction of movement of the materials of the stream contained within the physical transfer line signified by the arrow. Furthermore, arrows which do not connect two or more system components signify a product stream which exits the depicted system or a system inlet stream which enters the depicted system. Product streams may be further processed in accompanying chemical processing systems or may be commercialized as end products. System inlet streams may be streams transferred from accompanying chemical processing systems or may be non-processed feedstock streams. Some arrows may represent recycle streams, which are effluent streams of system components that are recycled back into the system. However, it should be understood that any represented recycle stream, in some embodiments, may be replaced by a system inlet stream of the same material, and that a portion of a recycle stream may exit the system as a system product.

Additionally, arrows in the drawings may schematically depict process steps of transporting a stream from one system component to another system component. For example, an arrow from one system component pointing to another system component may represent "passing" a system component effluent to another system component, which may include the contents of a process stream "exiting" or being "removed" from one system component and "introducing" the contents of that product stream to another system component. It should be understood that arrows in the relevant figures are not indicative of necessary or essential steps.

It should be understood that according to the embodiments presented in the relevant figures, an arrow between two system components may signify that the stream is not processed between the two system components. In other embodiments, the stream signified by the arrow may have substantially the same composition throughout its transport between the two system components. Additionally, it should be understood that in one or more embodiments, an arrow may represent that at least 75 wt. %, at least 90 wt. %, at least 95 wt. %, at least 99 wt. %, at least 99.9 wt. %, or even 100 wt. % of the stream is transported between the system components. As such, in some embodiments, less than all of the streams signified by an arrow may be transported between the system components, such as if a slip stream is present.

It should be understood that two or more process streams are "mixed" or "combined" when two or more lines intersect in the schematic flow diagrams of the relevant figures. Mixing or combining may also include mixing by directly introducing both streams into a like reactor, separation device, or other system component. For example, it should be understood that when two streams are depicted as being combined directly prior to entering a separation unit or reactor, that in some embodiments the streams could equivalently be introduced into the separation unit or reactor and be mixed in the reactor.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

Embodiments of the present disclosure relate to methods for processing aromatic compounds. The embodiments of FIGS. 1-4 are similar or identical in many ways, respectively, but include differences as described herein. Description of the embodiments of FIGS. 1-4 may generally apply to the embodiments of the other figures, as would be understood by those skilled in the art. For example, concepts disclosed herein applicable to FIG. 1 may be equally applicable to FIG. 2, 3, or 4, and vice versa, even if not explicitly stated as such herein.

As used in this disclosure, a "reactor," such as a hydrodearylation unit, described herein, refers to a vessel or series of vessels in which one or more chemical reactions may occur between one or more reactants optionally in the presence of one or more catalysts. For example, a reactor may include a plug-flow reactors, such as trickle-bed reactors, or continuous stirred tank reactors (CSTR) such as ebullated-bed reactors. Reactors, as described herein, may include a series of separate reactors. Additionally, reactors may include separation devices, such as those which separate catalyst from the reaction product. Such reactors may also include catalyst regeneration sections, as would be understood by those skilled in the art.

As used in this disclosure, a "catalyst" refers to any substance which increases the rate of a specific chemical reaction. Catalysts described in this disclosure may be utilized to promote various reactions, such as, but not limited to, hydrodearylation reactions. As described herein, the catalysts, including those used for hydrodearylation, may be utilized in fixed bed reactors. However, other reactor types are contemplated.

As used in this disclosure, a "separation unit" refers to any separation device or system of separation devices that at least partially separates one or more chemicals that are mixed in a process stream from one another. For example, a separation unit may selectively separate differing chemical species, phases, or sized material from one another, forming one or more chemical fractions. Examples of separation units include, without limitation, distillation columns, flash drums, knock-out drums, knock-out pots, centrifuges, cyclones, filtration devices, traps, scrubbers, expansion devices, membranes, solvent extraction devices, and the like. It should be understood that separation processes described in this disclosure may not completely separate all of one chemical constituent from all of another chemical constituent. It should be understood that the separation processes described in this disclosure "at least partially" separate different chemical components from one another, and that even if not explicitly stated, it should be understood that separation may include only partial separation.

In general, hydrocarbons may be described by their number of carbon atoms as "Cx-Cy", such as C6-C9, that refers to hydrocarbons having from 6 to 9 total carbon atoms. As described herein, "aromatic compound" refers to a hydrocarbon containing at least one benzene ring. An expression such as "Cx-Cy aromatic compounds" refers to aromatic compounds having from x to y carbon atoms. For example, "C6-C9 aromatic compounds" refers to aromatic compounds having from 6 to 9 carbon atoms. An expression such as "Cx+ aromatic compounds" refers to aromatic compounds having x or more carbon atoms. For example, "C11+ aromatic compounds" refers to aromatic compounds having 11 or more carbon atoms.

Now referring to FIG. 1, a hydrodearylation system is schematically depicted that includes a reactor 110 and a separation unit 120. In one or more embodiments, a hydrocarbon feed in stream 112, hydrogen in stream 116, and a recycle stream 128 may be passed to the reactor 110. The hydrocarbon feed in stream 112, the hydrogen in stream 116, and the recycle stream 128 may be contacted with one another in the reactor 110 and form a reactor effluent, present in stream 114. The term "reactor effluent" may refer to a stream that is passed out of a reactor or reaction zone. More generally, an "effluent" may refer to a stream that is passed out of a reactor, a reaction zone, or a separation unit, etc., following a particular reaction or separation. In general, the "effluent" may have a different composition than the stream or streams that entered the separation unit, reactor, or reaction zone.

In one or more embodiments, and as depicted in FIG. 1, one or more of the hydrocarbon feed in stream 112, the hydrogen in stream 116, or the recycle stream 128 may be combined with one another prior to being passed to the reactor 110. For example, the hydrocarbon feed in stream 112 and the recycle stream 128 may be combined with one another prior to being passed to the reactor 110, the hydrocarbon feed in stream 112 and the hydrogen in stream 116 may be combined with one another prior to being passed to the reactor 110, or the hydrogen in stream 116 and the recycle stream 128 may be combined with one another prior to being passed to the reactor 110. In other embodiments, the hydrocarbon feed in stream 112, the hydrogen in stream 116, and the recycle stream 128 may pass to the reactor 110 independently.

Still referring to FIG. 1, in one or more embodiments, the hydrocarbon feed of stream 112 may comprise at least 99 wt. % of one or more C9+ aromatic compounds. According to embodiments, one or more of the C9+ aromatic compounds may be alkyl-bridged non-condensed alkyl multi-aromatic compounds. As described herein, "alkyl-bridged non-condensed alkyl multi-aromatic compounds" refer to compounds that include at least two benzene rings connected by an alkyl bridge group having at least two carbons, wherein the benzene rings are connected to different carbons of the alkyl bridge group.

As described herein, the hydrocarbon feed of stream 112 may comprise at least 99 wt. % of one or more C9+ aromatic compounds. In additional embodiments, the hydrocarbon feed may comprise at least 99.5 wt. % of one or more C9+ aromatic compounds, or even at least 99.9 wt. % of one or more C9+ aromatic compounds. As is described in detail later herein, in one or more embodiments, the hydrocarbon feed may consist of one or more C9+ aromatic compounds. In various embodiments, the hydrocarbon feed may be a stream in an oil refinery produced by one or more treatments to crude oil. More specifically, the hydrocarbon feed may comprise a heavy aromatics stream from a unit operation of an oil refinery, such as from a xylene rerun column.

According to one or more embodiments, the hydrocarbon feed may comprise from 70 wt. % to 99 wt. % mono-aromatic compounds, such as from 75 wt. % to 94 wt. % mono-aromatic compounds or even from 91 wt. % to 94 wt. % mono-aromatic compounds. In some embodiments, the hydrocarbon feed may comprise from 1 wt. % to 20 wt. % di-aromatic compounds, such as from 4 wt. % to 15 wt. % di-aromatic compounds or even from 4 wt. % to 8 wt. % di-aromatic compounds. In some embodiments, the hydrocarbon feed may comprise 1 wt. % to 10 wt. % naphtheno-aromatic compounds, such as from 2 wt. % to 8 wt. % naphtheno-aromatic compounds or from 2 wt. % to 4 wt. % naphtheno-aromatic compounds. In one or more embodiments, the hydrocarbon feed may have a density of from 0.8 g/cc to 0.95 g/cc, such as, for example, from 0.883 g/cc to 0.9125 g/cc or even from 0.883 g/cc to 0.884 g/cc. In some embodiments, the hydrocarbon feed may have an initial boiling point of from 145° C. to 190° C., such as, for example, 153° C. to 182° C. In some embodiments, the hydrocarbon feed may have a final boiling point of from 320° C. to 360° C., such as from 328° C. to 350° C. or from 328° C. to 337° C.

According to one or more embodiments, the alkyl-bridged non-condensed alkyl multi-aromatic compounds, as described herein, may include a mixture of chemical compounds illustrated by Formula I, Formula II, and Formula III, and various combinations of these compounds.

[Formula I]

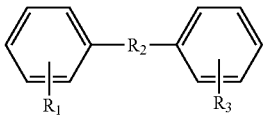

[Formula II]

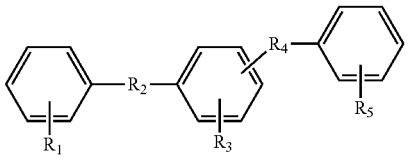

[Formula III]

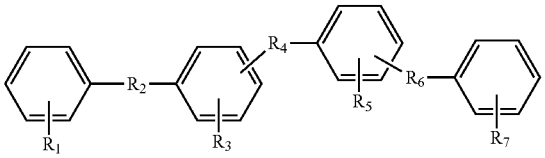

In Formula I, Formula II, and Formula III, $R_2$, $R_4$ and $R_6$ are alkyl bridge groups independently having from two to six carbon atoms. $R_1$, $R_3$, $R_5$, and $R_7$ are independently selected from the group consisting of hydrogen and an alkyl group having from one to eight carbon atoms. In addition to the groups, $R_1$, $R_3$, $R_5$, and $R_7$, the benzene groups of Formulas I, II, and III may further include additional alkyl groups connected to the benzene groups, respectively. In addition to the four benzene groups of Formula III, the various alkyl-bridged non-condensed alkyl multi-aromatic compounds may include five or more benzene groups connected by alkyl bridges, where the additional benzene groups further may include alkyl groups connected to the additional benzene groups.

Still referring to FIG. 1, in one or more embodiments, the hydrogen, present in stream 116, may have a feed rate to the reactor 110 of from 100 standard liters per liter (SLt/Lt) of hydrocarbon feed to 1000 SLt/Lt of hydrocarbon feed. In additional embodiments, the hydrogen may have a feed rate to the reactor 110 of from 100 SLt/Lt hydrocarbon feed to 200 SLt/Lt hydrocarbon feed, from 200 SLt/Lt hydrocarbon feed to 300 SLt/Lt hydrocarbon feed, from 300 SLt/Lt hydrocarbon feed to 400 SLt/Lt hydrocarbon feed, from 400 SLt/Lt hydrocarbon feed to 500 SLt/Lt hydrocarbon feed, from 500 SLt/Lt hydrocarbon feed to 600 SLt/Lt hydrocarbon feed, from 600 SLt/Lt hydrocarbon feed to 700 SLt/Lt hydrocarbon feed, from 700 SLt/Lt hydrocarbon feed to 800 SLt/Lt hydrocarbon feed, from 800 SLt/Lt hydrocarbon feed to 900 SLt/Lt hydrocarbon feed, from 900 SLt/Lt hydrocarbon feed to 1000 SLt/Lt hydrocarbon feed, or any combination of one or more of these ranges. The amount of hydrogen utilized may depend on operating conditions and specific reactants.

In one or more embodiments, the recycle stream 128 may comprise at least 90 wt. % of one or more C11+ aromatic compounds, wherein one or more of the C11+ aromatic compounds are alkyl-bridged non-condensed alkyl multi-aromatic compounds. For example, and in some embodiments, the recycle stream 128 may comprise at least 95 wt. % of one or more C11+ aromatic compounds, at least 99 wt. % of one or more C11+ aromatic compounds, at least 99.5 wt. % of one or more C11+ aromatic compounds, or at least 99.9 wt. % of one or more C11+ aromatic compounds. In embodiments, the recycle stream 128 may consist of one or more C11+ aromatic compounds. In various embodiments, the recycle stream 128 may be a stream in a petroleum refinery from one or more hydrocarbon treatments. More specifically, the recycle stream 128 may comprise an aromatics stream from a unit operation of a petroleum refinery, such as from an atmospheric distillation unit.

In some embodiments, the one or more of the C11+ aromatic compounds may include one or more of di-aromatic compounds (such as alkylated naphthalene), bicyclohexane (such as alkylated decalin), naphtheno-aromatic compounds (such as alkylated tetralin), naphtheno-di-aromatic compounds (such as tetrahydroanthracene), tri-aromatic compounds, tetra-aromatic compounds, bi-phenyl-aromatic compounds, or bicyclohexyl-aromatic compounds.

Still referring to FIG. 1, the reactor 110 may be a hydrodearylation unit. As described herein, "hydrodearylation" refers to a process for the cleaving of the alkyl bridge of non-condensed alkyl-bridged multi-aromatic compounds or heavy alkyl aromatic compounds to form mono-aromatic compounds in the presence of a catalyst and hydrogen.

In one or more embodiments, the reactor 110 may operate at a temperature from 200° C. to 450° C. For example, and in some embodiments, the reactor 110 may operate at a temperature from 275° C. to 375° C. In embodiments, the reactor 110 may operate at a temperature from 200° C. to 225° C., from 225° C. to 250° C., from 250° C. to 275° C., from 275° C. to 300° C., from 300° C. to 325° C., from 325° C. to 350° C., from 350° C. to 375° C., from 375° C. to 400° C., from 400° C. to 425° C., from 425° C. to 450° C., or any combination of one or more of these ranges. In one or more embodiments, the reactor 110 may operate at a temperature of less than or equal to 450° C. and at least 225° C., at least 250° C., at least 275° C., at least 300° C., at least 325° C., at least 350° C., at least 375° C., at least 400° C., or at least 425° C. In additional embodiments, the reactor 110 may operate at a temperature of at least 200° C. and less than or equal to 425° C., less than or equal to 400° C., less than or equal to 375° C., less than or equal to 350° C., less than or equal to 325° C., less than or equal to 300° C., less than or equal to 275° C., less than or equal to 250° C., or less than or equal to 225° C.

In one or more embodiments, the hydrogen partial pressure of the reactor 110 may be from 4 bar gauge to 50 bar gauge. For example, and in one or more embodiments, the hydrogen partial pressure of the reactor 110 may be from 4 bar gauge to 20 bar gauge. In embodiments, the hydrogen partial pressure of the reactor 110 may be from 4 bar gauge to 10 bar gauge, from 10 bar gauge to 15 bar gauge, from 15 bar gauge to 20 bar gauge, from 20 bar gauge to 25 bar gauge, from 25 bar gauge to 30 bar gauge, from 30 bar gauge to 35 bar gauge, from 35 bar gauge to 40 bar gauge, from 40 bar gauge to 45 bar gauge, from 45 bar gauge to 50 bar gauge, or any combination of one or more of these ranges. In one or more embodiments, the hydrogen partial pressure of the reactor 110 may be less than or equal to 50 bar gauge and at least 10 bar gauge, at least 15 bar gauge, at least 20 bar gauge, at least 25 bar gauge, at least 30 bar gauge, at least 35 bar gauge, at least 40 bar gauge, or at least 45 bar gauge. In additional embodiments, the hydrogen partial pressure of the reactor 110 may be at least 4 bar gauge and less than or equal to 45 bar gauge, less than or equal to 40 bar gauge, less than or equal to 35 bar gauge, less than or equal to 30 bar gauge, less than or equal to 25 bar gauge, less than or equal to 20 bar gauge, less than or equal to 15 bar gauge, or less than or equal to 10 bar gauge.

Still referring to FIG. 1, the reactor 110 may comprise a catalyst, such that the hydrocarbon feed in stream 112, the hydrogen in stream 116, and the recycle stream 128 may be contacted with one another in the reactor 110 in the presence of a catalyst. The catalyst may be provided as a catalyst bed in the reactor 110. In certain embodiments, the hydrogen may be fed to the catalyst bed of the reactor 110 to quench the catalyst bed. The catalyst bed may comprise two or more catalyst beds. In certain embodiments, the catalyst may include a support comprising silica, alumina, or combinations thereof and an acidic component comprising amorphous silica-alumina, zeolite, or combinations thereof. The catalyst may include an IUPAC Group 8-10 metal comprising iron, cobalt, nickel, or combinations thereof and an IUPAC Group 6 metal comprising molybdenum, tungsten, or combinations thereof. As described herein, "IUPAC Group 8-10 metal" and "IUPAC Group 6 metal" refers to those elements under International Union of Pure and Applied Chemistry (IUPAC) nomenclature. In one or more embodiments, the catalyst may comprise nickel, molybdenum, ultrastable Y-type zeolite, and γ-alumina support.

In embodiments comprising the IUPAC Group 8-10 metal, the catalyst may comprise from 0.1 to 20 wt. % of the IUPAC Group 8-10 metal. For example, and in one or more embodiments, the catalyst may comprise the IUPAC Group 8-10 metal in an amount from 0.1 wt. % to 2 wt. %, from 2 wt. % to 4 wt. %, from 4 wt. % to 6 wt. %, from 6 wt. % to 8 wt. %, from 8 wt. % to 10 wt. %, from 10 wt. % to 12 wt. %, from 12 wt. % to 14 wt. %, from 14 wt. % to 16 wt. %, from 16 wt. % to 18 wt. %, from 18 wt. % to 20 wt. %, or any combination of one or more of these ranges.

In one or more embodiments, the catalyst may comprise the IUPAC Group 8-10 metal in an amount of less than or equal to 20 wt. % and at least 4 wt. %, at least 6 wt. %, at least 8 wt. %, at least 10 wt. %, at least 12 wt. %, at least 14 wt. %, at least 16 wt. %, or at least 18 wt. %. In embodiments, the catalyst may comprise the IUPAC Group 8-10 metal in an amount of at least 2 wt. % and less than or equal to 18 wt. %, less than or equal to 16 wt. %, less than or equal to 14 wt. %, less than or equal to 12 wt. %, less than or equal to 10 wt. %, less than or equal to 8 wt. %, less than or equal to 6 wt. %, or less than or equal to 4 wt. %.

In embodiments comprising the IUPAC Group 6 metal, the catalyst may comprise from 0.1 to 25 wt. % of the IUPAC Group 6 metal. For example, and in one or more embodiments, the catalyst may comprise the IUPAC Group 6 metal in an amount from 0.1 wt. % to 5 wt. %, from 5 wt. % to 10 wt. %, from 10 wt. % to 15 wt. %, from 15 wt. % to 20 wt. %, from 20 wt. % to 25 wt. %, or any combination of one or more of these ranges.

In one or more embodiments, the catalyst may comprise the IUPAC Group 6 metal in an amount of less than or equal to 25 wt. % and at least 5 wt. %, at least 10 wt. %, at least 15 wt. %, or at least 20 wt. %. In embodiments, the catalyst may comprise the IUPAC Group 6 metal in an amount of at least 0.1 wt. % and less than or equal to 20 wt. %, less than or equal to 15 wt. %, less than or equal to 10 wt. %, or less than or equal to 5 wt. %.

Still referring to FIG. 1, and in one or more embodiments, a portion of the alkyl-bridged non-condensed alkyl multi-aromatic compounds may be converted to mono-aromatic compounds in the reactor 110, such that the reactor effluent, present in stream 114, comprises alkyl-bridged non-condensed alkyl multi-aromatic compounds and mono-aromatic compounds. As described herein, "mono-aromatic compounds" refer to benzene hydrocarbons composed of a single aromatic ring. Non-limiting examples of mono-aromatic compounds include benzene, toluene, ethylbenzene, and xylenes (BTEX).

By way of example and not limitation, the mono-aromatic compounds may include a mixture of chemical compounds illustrated by Formula IV.

[Formula IV]

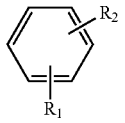

In Formula IV, for the various mono-aromatic compounds, $R_1$ may be independently selected from the group consisting of an alkyl group having from one to eight carbon atoms, and $R_2$ may be independently selected from the group consisting of hydrogen and an alkyl group having from one to eight carbon atoms.

Still referring to FIG. 1, and in one or more embodiments described herein, the reactor effluent in stream 114 may be passed to a separation unit 120 to form a first separated stream 122, a second separated stream 123, and a third separated stream 124. The separation unit 120 may be any suitable separation unit, such as, and without limitation, a flash vessel or fractionator/distillation column that separates feedstock based on the boiling point at a specified cut point. As described herein, the "cut point" in a separation generally identifies the approximate final boiling point of a lighter fraction and approximate initial boiling point of a heavier fraction based on atmospheric pressure conditions. In some embodiments, the cut point between the first separated stream 122 and the second separated stream 123 may be from 170° C. to 190° C., such as from 175° C. to 185° C. In some embodiments, the cut point between the first separated stream 122 and the second separated stream 123 may be about 180° C. In some embodiments, the cut point between the second separated stream 123 and the third separated stream 124 may be from 210° C. to 230° C., such as from 215° C. to 225° C. In some embodiments, the cut point between the second separated stream 123 and the third separated stream 124 may be about 220° C. In another embodiment, the cut point between the second separated stream 123 and the third separated stream 124 may be from 235° C. to 255° C., such as from 240° C. to 250° C. In some embodiments, the cut point between the second separated stream 123 and the third separated stream 124 may be about 245° C.

In one or more embodiments, the first separated stream 122 may comprise at least 90 wt. % of one or more C6-C9 aromatic compounds. For example, and in embodiments, the first separated stream 122 may comprise at least 95 wt. % of one or more C6-C9 aromatic compounds, at least 99 wt. % of one or more C6-C9 aromatic compounds, at least 99.5 wt. % of one or more C6-C9 aromatic compounds, or at least 99.9 wt. % of one or more C6-C9 aromatic compounds. In some embodiments, the first separated stream 122 may consist of one or more C6-C9 aromatic compounds.

In one or more embodiments, the second separated stream 123 may comprise at least 90 wt. % of one or more C11+ aromatic compounds. For example, the second separated stream 123 may comprise at least 95 wt. % of one or more C11+ aromatic compounds, at least 99 wt. % of one or more C11+ aromatic compounds, at least 99.5 wt. % of one or more C11+ aromatic compounds, or at least 99.9 wt. % of one or more C11+ aromatic compounds. In some embodiments, the second separated stream 123 may consist of one or more C11+ aromatic compounds.

In one or more embodiments, the third separated stream 124 may comprise at least 90 wt. % of C10 aromatic compounds. For example, the third separated stream 124 may comprise at least 95 wt. % of C10 aromatic compounds, at least 99 wt. % of C10 aromatic compounds, at least 99.5 wt. % of C10 aromatic compounds, or at least 99.9 wt. % of C10 aromatic compounds. In some embodiments, the third separated stream 124 may consist of C10 aromatic compounds. In one or more embodiments, at least a portion of the one or more C10 aromatic compounds in the third separated stream 124 may be condensed aromatic compounds. As described herein, "condensed" refers to aromatic compounds with monocyclic rings that share connected bonds. In some embodiments, the C10 aromatic compounds may comprise naphthalene.

Still referring to FIG. 1, the second separated stream 123 may be split into a first portion and a second portion. The first portion of the second separated stream 123 may be a bleed stream 126 that exits the hydrodearylation system 101. In one or more embodiments, the second portion of the second separated stream 123 may be the recycle stream 128 that is passed back to the reactor 110, as described herein.

According to one or more embodiments, the second portion of the second separated stream 123 (contained in the recycle stream 128) may comprise from 5 wt. % to 95 wt. % of the second separated stream 123. For example, and in embodiments, the second portion of the second separated stream 123 may comprise from 5 wt. % to 15 wt. %, from 15 wt. % to 25 wt. %, from 25 wt. % to 35 wt. %, from 35 wt. % to 45 wt. %, from 45 wt. % to 55 wt. %, from 55 wt. % to 65 wt. %, from 65 wt. % to 75 wt. %, from 75 wt. % to 85 wt. %, from 85 wt. % to 95 wt. %, or any combination of one or more of these ranges, of the second separated stream 123.

In one or more embodiments, the second portion of the second separated stream 123 (i.e., the recycle stream 128) may comprise the second separated stream 123 in an amount of less than or equal to 95 wt. % and at least 15 wt. %, at least 25 wt. %, at least 35 wt. %, at least 45 wt. %, at least 55 wt. %, at least 65 wt. %, at least 75 wt. %, or at least 85 wt. %.

In one or more embodiments, the recycle stream 128 may comprise the second separated stream 123 in an amount of at least 5 wt. % and less than or equal to 80 wt. %, less than or equal to 65 wt. %, less than or equal to 50 wt. %, less than or equal to 35 wt. %, or less than or equal to 20 wt. %.

As described herein, the first portion of the second separated stream 123 may be a bleed stream 126 that is not recycled to the reactor 110. The bleed stream 126 may comprise less than or equal to 100 ppmw of sulfur, nitrogen, or combinations thereof. For example, and in some embodiments, the bleed stream 126 may comprise sulfur, nitrogen, or combinations thereof in an amount of less than or equal to 90 ppmw, 80 ppmw, 70 ppmw, 60 ppmw, or even 50 ppmw. In embodiments, the bleed stream 126 may be utilized in downstream processes, such as production for high value carbon materials. For example, the bleed stream 126 may be utilized to produce activated carbon, carbon nanotubes, needle coke, carbon nanofibers, and graphite. In some embodiments, a portion of the third separated stream 124 may be combined with the bleed stream 126 prior to the bleed stream 126 being utilized in downstream processes. In one or more embodiments, the bleed rate may be at least 0.1 wt. % of the hydrocarbon feed (i.e., stream 112). In some embodiments, the bleed rate may be at least 1 wt. %, at least 5 wt. %, at least 10 wt. %, or even at least 20 wt. % of the hydrocarbon feed.

Without being bound by any particular theory, it is believed that separating the C10 aromatic compounds in the third separated stream 124 may prevent the buildup of condensed aromatic compounds in the reactor 110. Thus, the C10 aromatic compounds, if recycled, may not be converted to mono-aromatic compounds. Further, it is believed that recycling the C11+ aromatic compounds back to the reactor 110 may increase the conversion of uncondensed aromatic compounds.

Figure 2:
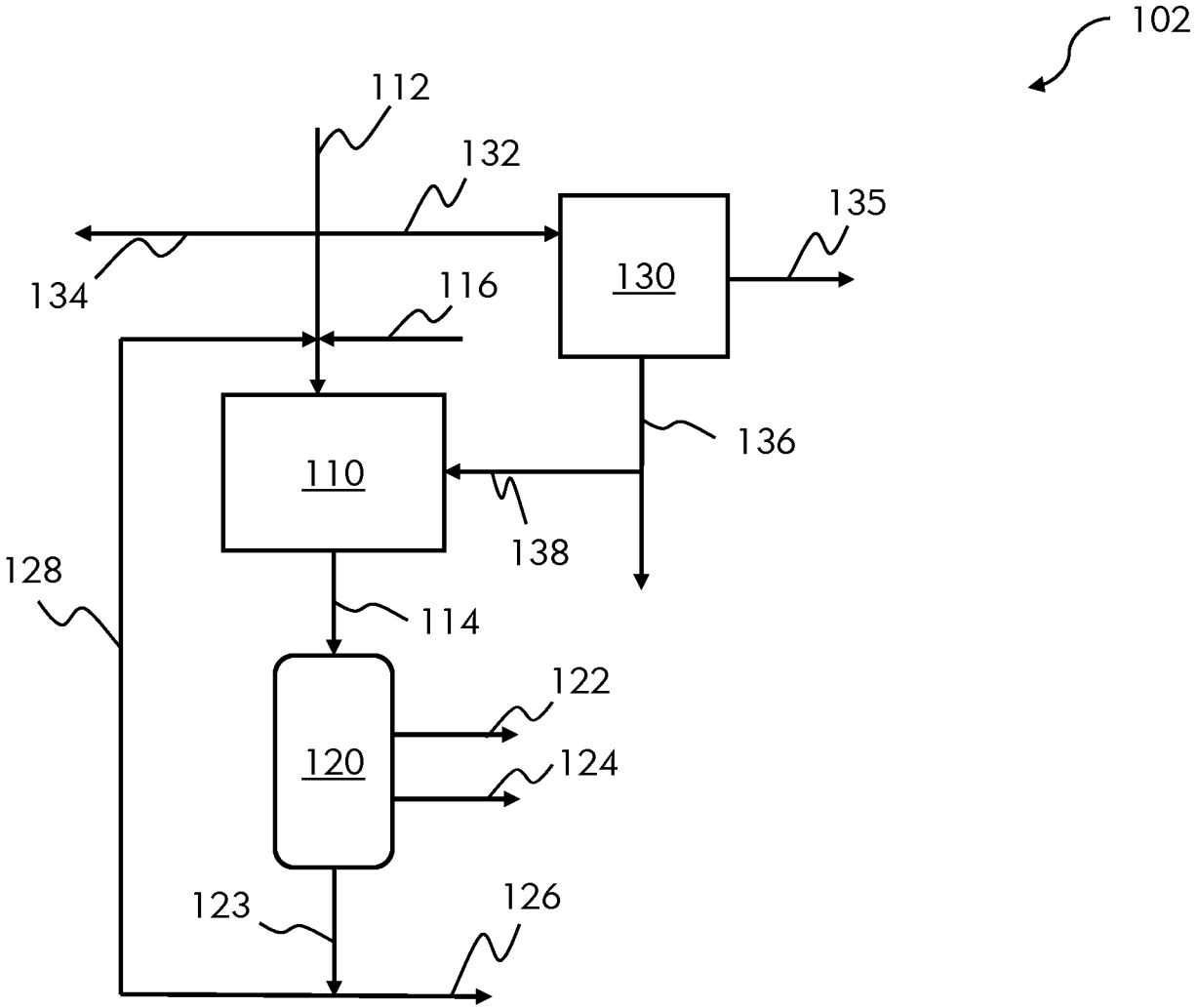
FIG. 2 schematically depicts a diagram of another hydrodearylation system, according to one or more embodiments described in this disclosure.

Now referring to FIG. 2, another hydrodearylation system 102 is depicted, which may be similar or identical to the hydrodearylation system of FIG. 1, except where described otherwise. In particular, and as described herein, the hydrodearylation system 102 may include a second separation unit 130. The second separation unit 130 may be an atmospheric distillation unit.

Still referring to FIG. 2, the hydrocarbon feed, present in stream 112, may be split into separate streams prior to being passed to the reactor 110. A portion of the hydrocarbon feed may be present in stream 134. Stream 134 may be utilized in downstream processes, such as fuel oil blending. Another portion of the hydrocarbon feed may be present in stream 132 and may be passed to the second separation unit 130 to form a light fraction, present in stream 135, and a heavy fraction, present in stream 136. According to one or more embodiments, the cut point between the light fraction and the heavy fraction may be from 170° C. to 190° C., such as from 175° C. to 185° C. In some embodiments, the cut point between the light fraction and the heavy fraction may be about 180° C. For example, the light fraction may have a maximum boiling point of from 170° C. to 190° C., such as about 180° C., and the heavy fraction may have a minimum boiling point of from 170° C. to 190° C., such as about 180° C.

In one or more embodiments, the light fraction in stream 135 may comprise one or more C9-C10 aromatic compounds. In one or more embodiments, the heavy fraction in stream 136 may comprise one or more C11+ aromatic compounds. A portion of the heavy fraction, present in stream 138, may be passed to the reactor 110 to be utilized in the hydrodearylation system 102. In embodiments, the heavy fraction in stream 136 not passed to the reactor 110 may be utilized in downstream processes, such as fuel oil blending.

Figure 3:
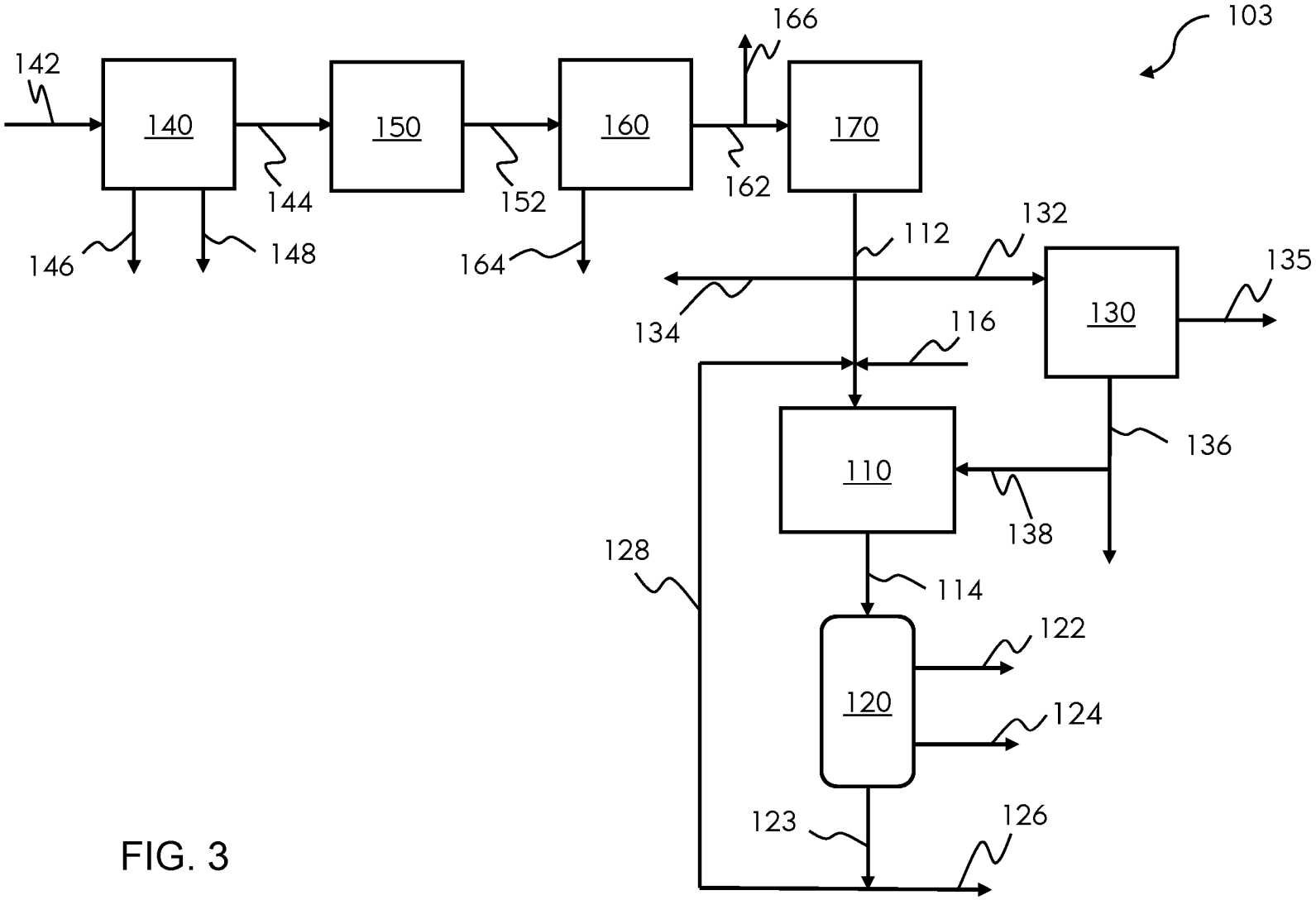
FIG. 3 schematically depicts a diagram of yet another hydrodearylation system, according to one or more embodiments described in this disclosure.

Now referring to FIG. 3, another hydrodearylation system 103 is depicted, which may be similar or identical to the hydrodearylation systems of FIG. 1 and FIG. 2, except where described otherwise. In particular, and as described herein, the hydrodearylation system 103 may include a distillation unit 140, a hydrotreatment unit 150, a catalytic reformer 160, and an aromatics recovery complex 170.

In one or more embodiments, crude oil may be passed via stream 142 to the distillation unit 140. In embodiments, the distillation unit 140 may be an atmospheric distillation unit. The crude oil may be separated in the distillation unit 140 to recover at least a naphtha fraction, present in stream 144, a diesel fraction, present in stream 146, and an atmospheric residue fraction, present in stream 148. The naphtha fraction may be passed via stream 144 to the hydrotreatment unit 150 to produce a hydrotreated effluent. The hydrotreatment unit may be a reactor in which crude oil cuts are selectively reacted with hydrogen in the presence of a catalyst at relatively high temperatures and moderate pressures to remove impurities, such as sulfur and nitrogen.

Still referring to FIG. 3, the hydrotreated effluent may be passed via stream 152 to the catalytic reformer 160 to form a reformate, present in stream 162, and a hydrogen stream 164. The hydrogen stream 164 may be utilized for processes in the reactor 110. The catalytic reformer 160 may include a reactor in which naphtha is converted into high-octane liquid products. The reformate may be passed to the aromatics recovery complex 170 to form one or more aromatic-containing streams, wherein the hydrocarbon feed comprises at least a portion of one of the aromatic-containing streams. A portion of the reformate, present in stream 166, may be split from the reformate.

Figure 4:
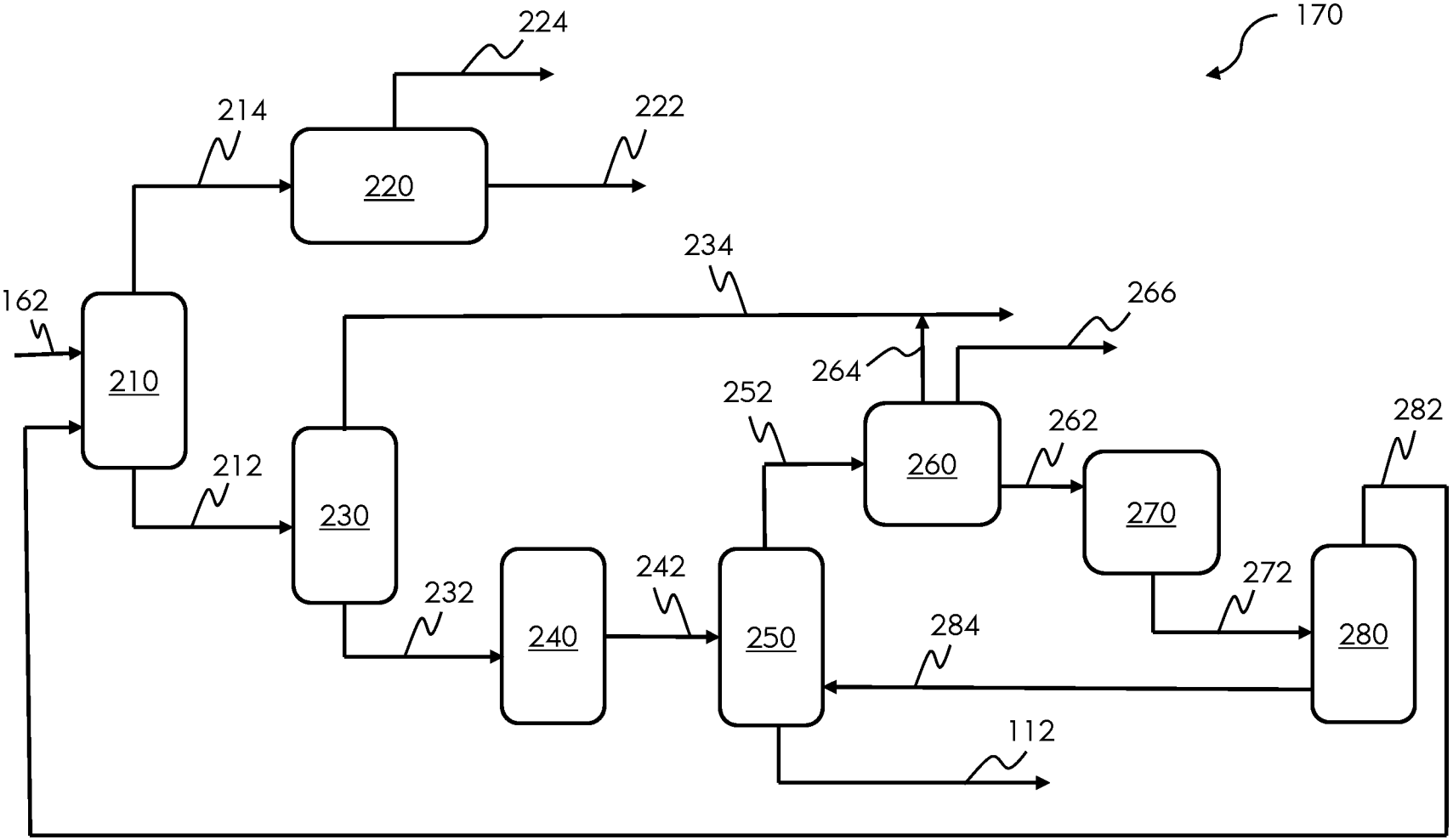
FIG. 4 schematically depicts a diagram of an aromatics recovery complex that may be utilized in the hydrodearylation system of FIG. 3, according to one or more embodiments described in this disclosure.

Now referring to FIG. 4, a diagram of an aromatics recovery complex 170 is depicted, which may be utilized in the embodiments of the hydrodearylation system 103 of FIG. 3, as described herein. As described herein, "aromatics recovery complex" refers to a combination of process units that can be used to convert petroleum naphtha and pyrolysis gasoline (pygas) into the basic petrochemical intermediates benzene, toluene, ethylbenzene, and xylenes (BTEX).

In one or more embodiments, a reformate may be passed via stream 162 to a splitter 210. The splitter 210 may have a top zone and a bottom zone. The top zone may be operated at a pressure from 0.3 MPa to 0.5 MPa above atmospheric pressure and a temperature from 70° C. to 90° C. The bottom zone may be operated at a higher temperature, such as from 150° C. to 200° C., for example.

Still referring to FIG. 4, the reformate may be split into a heavy stream 212 and a light stream 214. The light stream 214 may comprise one or more C5-C6 hydrocarbons. In embodiments, the light stream 214 may be sent to a benzene extraction unit 220 to extract the benzene, present in stream 222, and substantially benzene-free gasoline, present in stream 224, as raffinate motor gasoline ("mogas"), which may comprise one or more C5-C6 non-aromatic compounds. As used herein, the term "substantially benzene-free" refers to a stream that has less than or equal to 1000 ppm benzene.

In one or more embodiments, the heavy stream 212 may comprise one or more C7+ hydrocarbons. In embodiments, the heavy stream 212 may be passed to a splitter 230. The top zone of the splitter 230 may be operated at a pressure from 0.3 MPa to 0.5 MPa above atmospheric pressure and a temperature from 80° C. to 100° C., thereby producing a C7 cut mogas stream 234 and a C8+ hydrocarbon stream 232. The C8+ hydrocarbon stream 232 may then be passed to a clay treater 240 to form a clay treated C8+ hydrocarbon stream 242.

In one or more embodiments, the clay treated C8+ hydrocarbon stream 242 may be passed to a xylene rerun unit 250, which may separate the clay treated C8+ hydrocarbon stream 242 into a C8 hydrocarbon stream 252 and a C9+ hydrocarbon stream (i.e., the hydrocarbon feed present in stream 112, as described in FIGS. 1-3 herein), which may be a heavy aromatic mogas. The C8 hydrocarbon stream 252 may be sent to a p-xylene extraction unit 260 to recover p-xylene, present in stream 266. The p-xylene extraction unit 260 may also produce a C7 cut mogas stream 264, which may be combined with the C7 cut mogas stream 234 from the splitter 230.

Still referring to FIG. 4, a xylene stream 262 comprising o-xylenes and m-xylenes may be recovered from the p-xylene extraction unit 260 and passed to a xylene isomerization unit 270 to convert to p-xylene, present in stream 272. The p-xylene may be passed to a splitter 280 to form a converted fraction, present in stream 282. The splitter 280 may operate at a top zone pressure from 0.3 MPa to 0.5 MPa above atmospheric pressure. The converted fraction may be recycled to the xylene rerun unit 250. The top stream from the splitter 280 may be recycled to the splitter 210.

The present disclosure includes numerous aspects, including aspects 1-20 described herein.

Aspect 1. A method for processing one or more aromatic compounds, the process comprising: passing a hydrocarbon feed, hydrogen, and a recycle stream to a reactor, such that the hydrocarbon feed, the hydrogen, and the recycle stream are contacted with one another in the reactor and form a reactor effluent, wherein: the hydrocarbon feed comprises at least 99 wt. % of one or more C9+ aromatic compounds, wherein one or more of C9+ aromatic compounds are alkyl-bridged non-condensed alkyl multi-aromatic compounds; the recycle stream comprises at least 90 wt. % of one or more C11+ aromatic compounds, wherein one or more of C11+ aromatic compounds are alkyl-bridged non-condensed alkyl multi-aromatic compounds; and a portion of the alkyl-bridged non-condensed alkyl multi-aromatic compounds are converted to mono-aromatic compounds in the reactor, such that the reactor effluent comprises alkyl-bridged non-condensed alkyl multi-aromatic compounds and mono-aromatic compounds; passing the reactor effluent to a separation unit to form: a first separated stream comprising at least 90 wt. % of one or more C6-C9 aromatic compounds; a second separated stream comprising at least 90 wt. % of one or more C11+ aromatic compounds; and a third separated stream comprising at least 90 wt. % of C10 aromatic compounds; and splitting the second separated stream into a first portion and a second portion, wherein the recycle stream consists of the second portion of the second separated stream, and wherein the second portion of the second separated stream comprises from 5 wt. % to 95 wt. % of the second separated stream.

Aspect 2. The method of aspect 1, wherein one or more of the hydrocarbon feed, the hydrogen, or the recycle stream are combined with one another prior to being passed to the reactor.

Aspect 3. The method of any previous aspect, wherein at least a portion of the C10 aromatic compounds in the third separated stream are condensed aromatic compounds.

Aspect 4. The method of any previous aspect, wherein the first portion of the second separated stream is a bleed stream that is not recycled to the reactor.

Aspect 5. The method of any previous aspect, wherein the third separated stream comprises naphthalenes.

Aspect 6. The method of any previous aspect, wherein the bleed rate is at least 0.1 wt. % of the hydrocarbon feed.

Aspect 7. The method of any previous aspect, further comprising combining a portion of the third separated stream with the bleed stream.

Aspect 8. The method of any previous aspect, wherein the first portion of the second separated stream comprises less than or equal to 100 ppmw of sulfur, nitrogen, or combinations thereof.

Aspect 9. The method of any previous aspect, wherein the reactor comprises a catalyst.

Aspect 10. The method of any previous aspect, wherein the catalyst comprises a support comprising silica, alumina, or combinations thereof and an acidic component comprising amorphous silica-alumina, zeolite, or combinations thereof.

Aspect 11. The method of any previous aspect, wherein the catalyst comprises an IUPAC Group 8-10 metal comprising iron, cobalt, nickel, or combinations thereof and an IUPAC Group 6 metal comprising molybdenum, tungsten, or combinations thereof.

Aspect 12. The method of any previous aspect, wherein the IUPAC Group 8-10 metal is from 0.1 wt. % to 20 wt. % of the catalyst.

Aspect 13. The method of any previous aspect, wherein the IUPAC Group 6 metal is from 0.1 wt. % to 25 wt. % of the catalyst.

Aspect 14. The method of any previous aspect, wherein the catalyst comprises nickel, molybdenum, ultrastable Y-type zeolite, and γ-alumina support.

Aspect 15. The method of any previous aspect, wherein the operating temperature of the reactor is from 200° C. to 450° C.

Aspect 16. The method of any previous aspect, wherein the hydrogen partial pressure of the reactor is from 4 bar gauge to 50 bar gauge.

Aspect 17. The method of any previous aspect, further comprising passing the hydrogen to the reactor at a feed rate of from 100 standard liters per liter of hydrocarbon feed to 1000 standard liters per liter of hydrocarbon feed.

Aspect 18. The method of any previous aspect, further comprising: passing a portion of the hydrocarbon feed to a second separation unit to form a light fraction comprising one or more C9-C10 aromatic compounds and a heavy fraction comprising one or more C11+ aromatic compounds; and passing a portion of the heavy fraction to the reactor.

Aspect 19. The method of any previous aspect, wherein a cut point between the light fraction and the heavy fraction is from 170° C. to 190° C.

Aspect 20. The method of any previous aspect, further comprising: separating crude oil in a distillation unit to recover at least a naphtha fraction, a diesel fraction, and an atmospheric residue fraction; passing the naphtha fraction to a hydrotreatment unit to produce a hydrotreated effluent; passing the hydrotreated effluent to a catalytic reformer to form a reformate; and passing a portion of the reformate to an aromatics recovery complex to form one or more aromatic-containing streams, wherein the hydrocarbon feed comprises at least a portion of one of the aromatic-containing streams.

It is noted that one or more of the following claims utilize the term "wherein" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

Any quantitative value expressed in the present application may be considered to include open-ended embodiments consistent with the transitional phrases "comprising" or "including" as well as closed or partially closed embodiments consistent with the transitional phrases "consisting of" and "consisting essentially of."

It is also noted that recitations herein of "at least one" component, element, etc., should not be used to create an inference that the alternative use of the articles "a" or "an" should be limited to a single component, element, etc.

What is claimed is:

1. A method for processing one or more aromatic compounds, the process comprising:

passing a hydrocarbon feed, hydrogen, and a recycle stream to a reactor, such that the hydrocarbon feed, the hydrogen, and the recycle stream are contacted with one another in the reactor and form a reactor effluent, wherein:

the hydrocarbon feed comprises at least 99 wt. % of one or more C9+ aromatic compounds, wherein one or more of C9+ aromatic compounds are alkyl-bridged non-condensed alkyl multi-aromatic compounds;

the recycle stream comprises at least 90 wt. % of one or more C11+ aromatic compounds, wherein one or more of C11+ aromatic compounds are alkyl-bridged non-condensed alkyl multi-aromatic compounds; and a portion of the alkyl-bridged non-condensed alkyl multi-aromatic compounds are converted to mono-aromatic compounds in the reactor, such that the reactor effluent comprises alkyl-bridged non-condensed alkyl multi-aromatic compounds and mono-aromatic compounds;

passing the reactor effluent to a separation unit to form:

a first separated stream comprising at least 90 wt. % of one or more C6-C9 aromatic compounds;

a second separated stream comprising at least 90 wt. % of one or more C11+ aromatic compounds; and a third separated stream comprising at least 90 wt. % of C10 aromatic compounds; and splitting the second separated stream into a first portion and a second portion, wherein the recycle stream consists of the second portion of the second separated stream, and wherein the second portion of the second separated stream comprises from 5 wt. % to 95 wt. % of the second separated stream.

2. The method of claim 1, wherein one or more of the hydrocarbon feed, the hydrogen, or the recycle stream are combined with one another prior to being passed to the reactor.

3. The method of claim 1, wherein at least a portion of the C10 aromatic compounds in the third separated stream are condensed aromatic compounds.

4. The method of claim 1, wherein the first portion of the second separated stream is a bleed stream that is not recycled to the reactor.

5. The method of claim 3, wherein the third separated stream comprises naphthalenes.

6. The method of claim 4, wherein the bleed rate is at least 0.1 wt. % of the hydrocarbon feed.

7. The method of claim 4, further comprising combining a portion of the third separated stream with the bleed stream.

8. The method of claim 1, wherein the first portion of the second separated stream comprises less than or equal to 100 ppmw of sulfur, nitrogen, or combinations thereof.

9. The method of claim 1, wherein the reactor comprises a catalyst.

10. The method of claim 9, wherein the catalyst comprises a support comprising silica, alumina, or combinations thereof and an acidic component comprising amorphous silica-alumina, zeolite, or combinations thereof.

11. The method of claim 9, wherein the catalyst comprises an IUPAC Group 8-10 metal comprising iron, cobalt, nickel, or combinations thereof and an IUPAC Group 6 metal comprising molybdenum, tungsten, or combinations thereof.

12. The method of claim 11, wherein the IUPAC Group 8-10 metal is from 0.1 wt. % to 20 wt. % of the catalyst.

13. The method of claim 11, wherein the IUPAC Group 6 metal is from 0.1 wt. % to 25 wt. % of the catalyst.

14. The method of claim 9, wherein the catalyst comprises nickel, molybdenum, ultrastable Y-type zeolite, and γ-alumina support.

15. The method of claim 1, wherein the operating temperature of the reactor is from 200° C. to 450° C.

16. The method of claim 1, wherein the hydrogen partial pressure of the reactor is from 4 bar gauge to 50 bar gauge.

17. The method of claim 1, further comprising passing the hydrogen to the reactor at a feed rate of from 100 standard liters per liter of hydrocarbon feed to 1000 standard liters per liter of hydrocarbon feed.

18. The method of claim 1, further comprising:

passing a portion of the hydrocarbon feed to a second separation unit to form a light fraction comprising one or more C9-C10 aromatic compounds and a heavy fraction comprising one or more C11+ aromatic compounds; and passing a portion of the heavy fraction to the reactor.

19. The method of claim 18, wherein a cut point between the light fraction and the heavy fraction is from 170° C. to 190° C.

20. The method of claim 1, further comprising:

separating crude oil in a distillation unit to recover at least a naphtha fraction, a diesel fraction, and an atmospheric residue fraction;

passing the naphtha fraction to a hydrotreatment unit to produce a hydrotreated effluent;

passing the hydrotreated effluent to a catalytic reformer to form a reformate; and passing a portion of the reformate to an aromatics recovery complex to form one or more aromatic-containing streams, wherein the hydrocarbon feed comprises at least a portion of one of the aromatic-containing streams.

* * * * *